US007814948B2

(12) United States Patent
Amante

(10) Patent No.: US 7,814,948 B2
(45) Date of Patent: Oct. 19, 2010

(54) PROTECTIVE HANDBAG COVER

(76) Inventor: Jacqueline Amante, 614 Walcott Way, Cary, NC (US) 27519

( * ) Notice: Subject to any disclaimer, the term of this patent is extended or adjusted under 35 U.S.C. 154(b) by 99 days.

(21) Appl. No.: 12/106,308

(22) Filed: Apr. 20, 2008

(65) Prior Publication Data

US 2008/0264531 A1 Oct. 30, 2008

Related U.S. Application Data

(60) Provisional application No. 60/926,083, filed on Apr. 24, 2007.

(51) Int. Cl.
*A45C 13/30* (2006.01)
*A45C 3/06* (2006.01)

(52) U.S. Cl. ..... 150/106; 150/112; 150/127

(58) Field of Classification Search ..... 150/103–106, 150/112, 127, 154; 383/43, 111, 61.1, 61.4, 383/91; 190/26

See application file for complete search history.

(56) References Cited

U.S. PATENT DOCUMENTS 1,479,135 A * 1/1924 Guinzburg ..... 383/43
2,037,175 A * 4/1936 Northcross ..... 493/210
2,622,648 A * 12/1952 Ingram ..... 150/101
2,711,234 A * 6/1955 Rubens ..... 190/26
2,845,974 A * 8/1958 Arden ..... 150/105
D272,868 S * 3/1984 Jaffee ..... D3/321
4,716,947 A 1/1988 Haddock
4,953,704 A 9/1990 Cortese
5,010,987 A * 4/1991 Evans ..... 190/26
5,172,795 A 12/1992 Riceman
5,255,833 A 10/1993 McAllister
6,974,007 B2 * 12/2005 Raines ..... 190/26
7,077,251 B1 * 7/2006 Gaither ..... 190/26
2001/0015248 A1 * 8/2001 McCreery ..... 150/104
2003/0142887 A1 * 7/2003 Sleight et al. ..... 383/7
2005/0133558 A1 6/2005 Toombs
2006/0086444 A1 4/2006 Yu
2006/0144487 A1 7/2006 Bockey
2006/0175171 A1 8/2006 Johnson
2007/0193667 A1 8/2007 Beakey

FOREIGN PATENT DOCUMENTS

FR 2898019 A1 * 9/2007

* cited by examiner

*Primary Examiner*—Sue A Weaver
(74) *Attorney, Agent, or Firm*—Andover Patents, LLC; Daniel N. Beinart

(57) ABSTRACT

A device for protecting a handbag includes a bag, one or more elastic bands and an optional pliable trim piece, each attached to the bag. The elastic bands encircle the bag and are positioned between the opening and the bottom of the bag. The pliable trim piece encircles the bag and is positioned at the opening of the bag.

6 Claims, 3 Drawing Sheets

PROTECTIVE HANDBAG COVER

CROSS-REFERENCED TO RELATED APPLICATIONS

This is a Non-Provisional application of U.S. Provisional Application Ser. No. 60/926,083 filed Apr. 24, 2007.

FIELD OF THE INVENTION

The present invention relates generally to the field of articles used for covering and/or protecting a handled carrying container, and more particularly to a protective cover which protects the carrying container from the elements of the weather.

BACKGROUND OF THE INVENTION

Many individuals spend hundreds of dollars on handbags made of leather, suede, and other delicate materials only to have them damaged or ruined by exposure to damp, wet or icy weather conditions, or by exposure to sun. In many cases, the damage is expensive or even impossible to remedy by cleaning or restoration methods. Furthermore, the moisture associated with such weather conditions frequently penetrates through the material of the handbag, reaching the contents held within the handbag, thus subjecting those contents to similar damage or ruin.

A common protective article, such as a plastic bag or duffle bag, may be used in such a way as to completely cover a handbag, including the handbag's handles. In such case, the handbag's handles are therefore not accessible for use in carrying the handbag. A raincoat or umbrella may also be used in an attempt to shield a handbag from the weather. However, a using a raincoat for such a purpose has the disadvantage of requiring the person to carry the handbag in an uncomfortable manner. Using an umbrella for such purpose typically does not provide adequate protection to the handbag, since the person typically cannot position the umbrella to completely keep the rain from striking the handbag.

Therefore a need exists for an article for protecting a handbag or other handled carrying container wherein the handbag can easily be placed within, accessed or removed from the protective article, and which permits the handbag to be carried by its handles or straps while protecting the handbag from the weather.

A device constructed according to the principles of the present invention addresses these deficiencies.

BRIEF SUMMARY OF THE INVENTION

In accordance with principles of the present invention, a protective cover for protecting a handbag or other handled carrying container includes a bag having an attached elastic band and an optional attached pliable trim piece. The elastic band substantially encircles the bag, positioned between the opening of the bag and the bottom of the bag. The pliable trim piece also substantially encircles the bag and is positioned along, or near to, the opening of the bag.

The elastic band permits the opening of the protective handbag cover to stretch to allow a handbag or handled carrying container to easily be placed inside with the handles or straps of the handbag protruding from the protective handbag cover. The elastic band forms a first closure around the handles of the handbag, thereby protecting the handbag from the weather. The pliable trim piece, when wrapped around the handles of the handbag, serves as a second closure to further protect the handbag.

The protective handbag cover is for use in protecting a handbag, purse, knapsack or any handled carrying container from the elements. In addition, the protective handbag cover can be for use at the beach to provide protection from sand, or during travel to protect a handbag from dirt and other contamination.

Further object to this invention is to provide additional pockets which can house snacks, umbrellas, rain hats, etc.

Other objects and features of the present invention will become apparent from the detailed description considered in connection with the accompanied drawings. It is to be understood however, that the drawings are designed as an illustration only and not as definition of the limits of the invention. It is obvious that many changes and modifications may be made thereunto without departing from the spirit and scope of the invention.

DETAILED DESCRIPTION OF THE INVENTION

Figure 1:
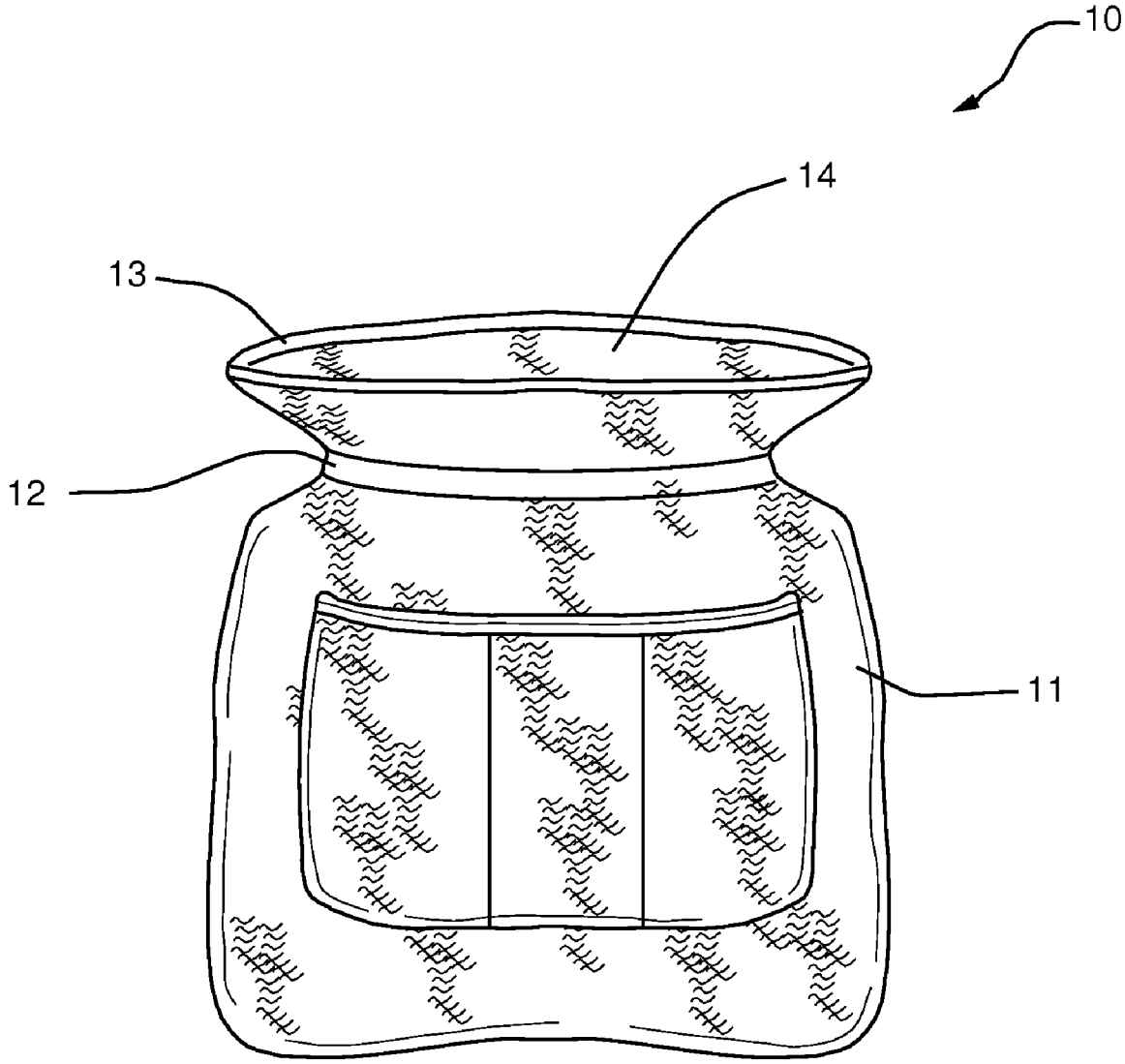
FIG. 1 is a diagram of a protective handbag cover in accordance with principles of the present invention.

FIG. 1 is a diagram of an embodiment of a protective handbag cover in accordance with principles of the present invention. As depicted in FIG. 1, the protective handbag cover 10 comprises a bag 11, a stretchable elastic band 12 and a pliable trim piece 13. The elastic band 12 substantially encircles the circumference of the bag 11 along a line that typically a few inches removed from the opening 14 of the bag 11. The pliable trim piece 13 also substantially encircles the circumference of the bag 11 along a line that is substantially coincident with the perimeter of the opening 14 of the bag 11.

The elastic band 12 may be sewn, glued, or otherwise attached to the inner or outer surface of the bag 11. In an alternative embodiment, the bag 11 has a hem (not shown), and the elastic band 12 is contained within the hem of the bag 11, so that the elastic band 12 is sandwiched between two layers of the bag 11. In another alternate embodiment, the bag 11 has a gusset (not shown) substantially encircling the circumference of the bag 11, and the elastic band 12 is contained within the gusset, which is sealed by stitching, adhesive or other suitable means.

One skilled in the art will recognize that a bag 11 may be comprised of two or more attached panels, as an alternative to the single bag depicted in FIG. 1. Furthermore, alternate embodiments of the protective handbag cover 10 include more than one elastic band 12 (not shown). The more than one elastic bands 12 may be roughly parallel to each other, each substantially encircling the circumference of the bag 11.

Figure 2:
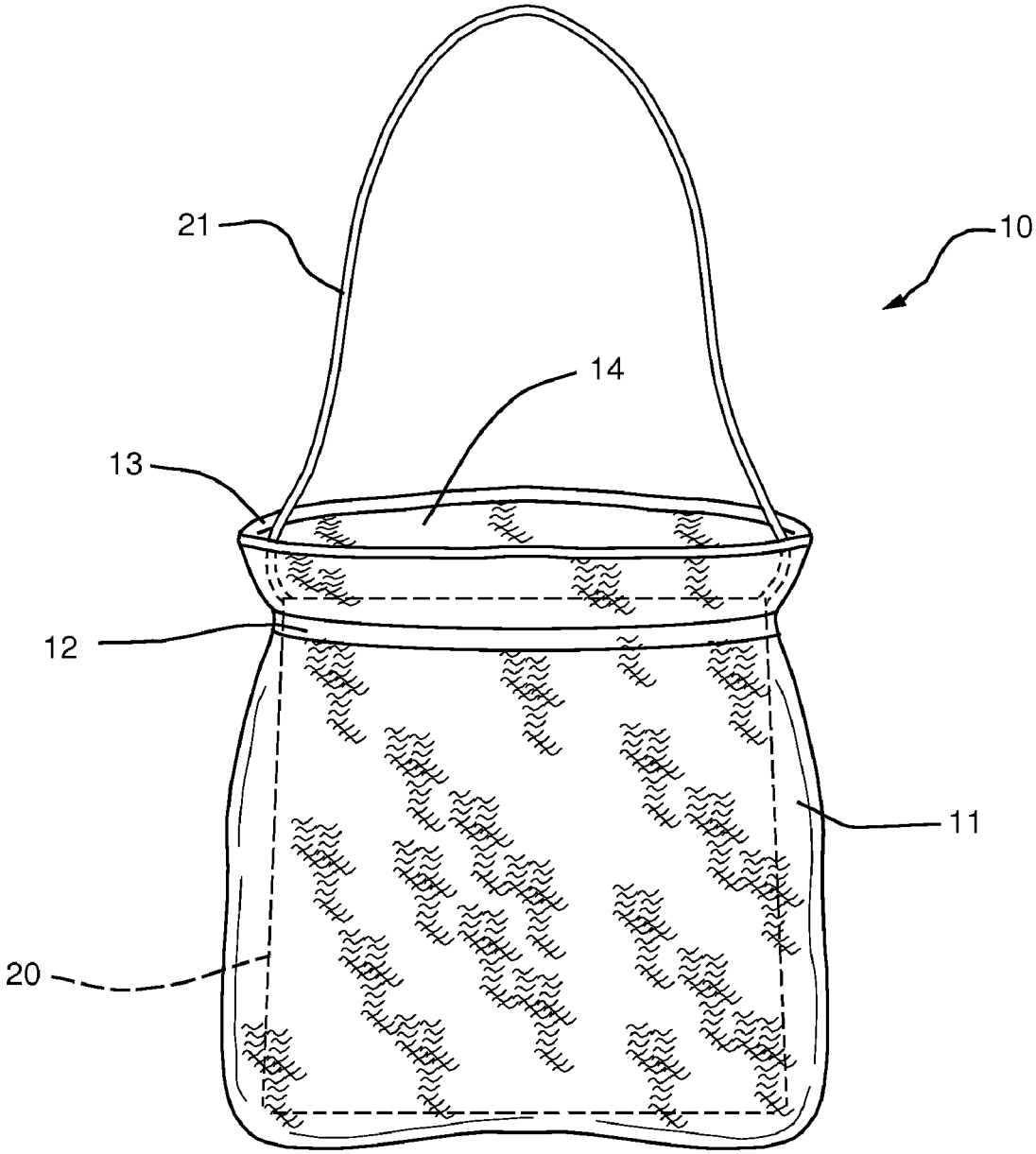
FIG. 2 depicts a protective handbag cover in accordance with principles of the present invention in a partially closed configuration.

To use a protective handbag cover 10, a handbag 20 or other handled carrying container is placed inside the protective handbag cover 10, with the handles 21 of the handbag 20 left protruding from the opening 14 of the bag 11. After the handbag 20 has been placed inside the protective handbag cover 10, the elastic band 12 contracts (i.e., relaxes) to form a first closure around the handles 21 of the handbag 20, thereby protecting the handbag 20 from the weather. A protective handbag cover 10 in such a partially closed configuration is depicted in FIG. 2.

Figure 3:
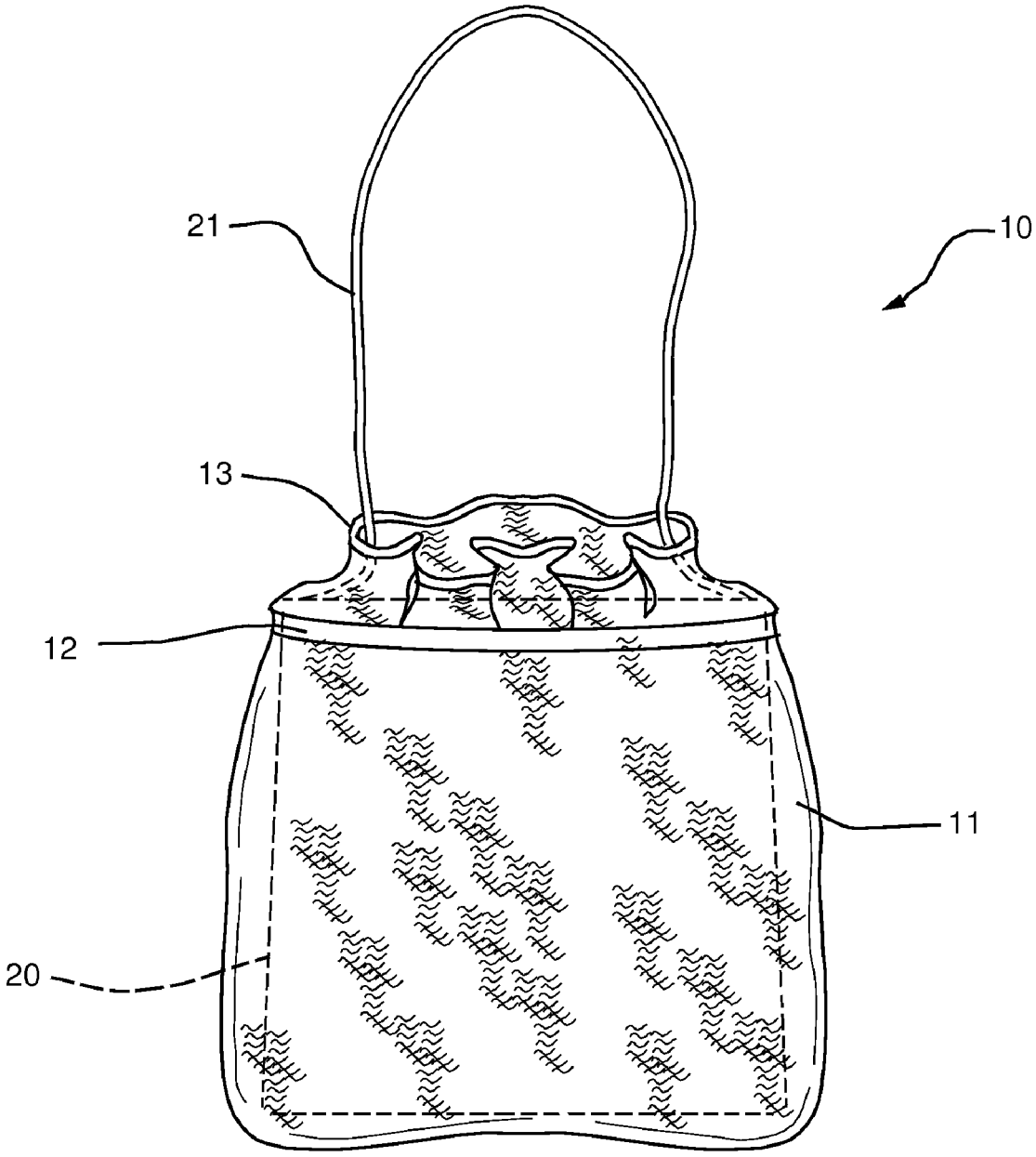
FIG. 3 depicts a protective handbag cover in accordance with principles of the present invention in a closed configuration.

Once the protective handbag cover 1 0 is in this partially closed configuration, the pliable trim piece 13 is then wrapped around the handles 21 of the handbag 20. In this fully closed configuration of the protective handbag cover 10, depicted in FIG. 3, the pliable trim piece 13 serves as an additional, reinforcing closure to further protect the handbag 20 from the weather.

The protective handbag cover 10 can be made of an inexpensive plastic or any suitable waterproof or water-resistant material and can be either be reused or disposable after one or more uses. In some embodiments, the protective handbag cover 10 can be made of transparent or translucent, clear or light-colored plastic, so that the contents inside the protective handbag cover 10 can be seen while inside of the protective handbag cover 10. The elastic band 12, which can be made of elastic, rubber or other suitable stretchable elastic material forms a closure that will open when pulled and spring back and close by itself, thereby allowing easy access to the handbag 20 without removing it from the protective handbag cover 10. Furthermore, the elastic band 12 allows the protective handbag cover 10 to maintain its position of covering the handbag 20 while at the same permitting the contents of the handbag 20 to be accessed. The protective handbag cover 10 can optionally be folded to allow it to be carried in the handbag 20 during fair weather conditions.

The inner and outer surfaces of the bag 11 can be made of different materials and/or finishes, in which case the protective handbag cover 10 can be reversible to provide a choice of decorative appearance of the protective handbag cover 10.

One or more pockets (shown in FIG. 1) can be attached to the inner or outer surfaces of the bag 11, thus permitting storage within the pockets of various items, such as umbrellas, gloves, rain hats, snacks, drinks, cell phones, etc. Furthermore, additional items may be stored within the protective handbag cover 10 as space permits, in between the handbag 20 and the inner surface of the bag 11.

The pliable trim piece 13 can be made up of wire material combined with a decorative ribbon, or a metal and plastic combination. An alternate embodiment (not shown) of the protective handbag cover 10 does not include the pliable trim piece 13. In such an embodiment, the elastic band 12 still serves a closure to protect the handbag 20 from the weather, and the opening 14 of the bag 11 can be folded around the handle 21 of the handbag 20. In another embodiment of the protective handbag cover 10, the pliable trim piece 13 can be made of or include Velcro or similar hook-and-loop fasteners material, suitable for adhering to itself or to a complementary Velcro or similar material on the outside of the bag 11, to provide additional protection for the handbag 20.

In some embodiments, the bag 11 can be made of stretchable material, thus making the protective handbag cover 10 able to accommodate handbags of various sizes. Furthermore, the protective handbag cover 10 is not limited in size and can be used to carry additional items if needed.

The pliable trim piece 13 can also can be combined with a decorative ribbon, thereby serving a decorative purpose in addition to serving as a second closure of the protective handbag cover 10. In addition, rhinestones, ribbon and other decorations can be used to make the protective handbag cover 10 appear more stylish. Furthermore, the protective handbag cover 10, or any of its constituent elements, may be imprinted with a company's logo or other design for marketing or advertising purposes.

A protective handbag cover 10 may be packaged in a small pouch or a clear plastic ball, either of which may include a snap or hook to attach the packaged protective handbag cover 10 to an umbrella, stroller, handbag or other convenient item.

The protective handbag cover thus addresses the problem of protecting a handbag in such a way that the handbag can easily be placed within, accessed or removed from the protective handbag cover, and permitting the handbag to be carried by its handles or straps while protecting the handbag from the weather.

While a particular form and use of the present invention has been described above, the invention is not limited to the specific arrangement of parts or manner of use described.

One skilled in the art understands that modifications to the construction and use of the present system may be made without departing from the scope of the invention.

Although the invention has been described in terms of exemplary embodiments, it is not limited thereto. Rather, the appended claims should be construed broadly to include other variants and embodiments of the invention which may be made by those skilled in the art without departing from the scope and range of equivalents of the invention. This disclosure is intended to cover any adaptations or variations of the embodiments discussed herein.

What is claimed is:

1. A device for protecting a handbag, the device comprising:

(a) a bag having an opening, a bottom, an inner surface and an outer surface;

(b) one or more elastic bands attached to the bag, said bands substantially encircling the bag and positioned between said opening and said bottom, said bands forming a first closure of the device; and (c) a pliable trim piece comprised of wire attached to the bag, said trim piece substantially encircling the bag and positioned at said opening, said pliable trim piece forming a second closure of the device.

2. The device of claim 1, further comprising one or more pockets attached to said outer surface of the bag.

3. The device of claim 1, wherein the bag is made of stretchable material.

4. A device for protecting a handbag, the device comprising:

(a) a bag having an opening, a bottom, an inner surface and an outer surface;

(b) two or more elastic bands attached to the bag, said bands substantially encircling the bag and positioned between said opening and said bottom, said bands forming a first closure of the device; and (c) a pliable trim piece comprised of wire attached to the bag, said trim piece substantially encircling the bag and positioned at said opening, said pliable trim piece forming a second closure of the device.

5. The device of claim 4, further comprising one or more pockets attached to said outer surface of the bag.

6. The device of claim 4, wherein the bag is made of stretchable material.

* * * * *